US005536212A

United States Patent [19]

Tryon

[11] Patent Number: 5,536,212

[45] Date of Patent: Jul. 16, 1996

[54] ADJUSTABLE THUMB HOLE INSERT FOR BOWLING BALLS

[76] Inventor: David H. Tryon, 285 E. Mill St. #N, San Bernardino, Calif. 92408

[21] Appl. No.: 343,335

[22] Filed: Nov. 21, 1994

[51] Int. Cl.[6] ..... A63B 37/00

[52] U.S. Cl. ..... 473/129; 473/130

[58] Field of Search ..... 473/127, 128, 473/129, 130

[56] References Cited

U.S. PATENT DOCUMENTS

| | | | |
|---|---|---|---|
| 2,210,528 | 8/1940 | Darby | 473/129 |
| 2,372,958 | 4/1945 | Keith | 473/129 |
| 3,012,783 | 12/1961 | Bunk et al. | 473/129 |
| 3,416,796 | 12/1968 | Ginder | 473/129 |
| 4,561,654 | 12/1985 | Haza | 473/129 |
| 4,968,033 | 11/1990 | Alutto | 473/129 |

*Primary Examiner*—William M. Pierce
*Attorney, Agent, or Firm*—Edgar W. Averill, Jr.

[57] ABSTRACT

An adjustable thumb hole insert for a bowling ball. A bowling ball having an oversized thumb hole has an adjustment cup positioned within it. The adjustment cup is tapered at the bottom and at the top. A thumb collet is positioned within the adjustment cup and has a generally cylindrical sidewall surrounding the thumb hole. The thumb collet is tapered at the bottom and at the top and is held in the over-sized thumb hole of the bowling ball. An adjustment screw is held in the bottom of the adjustment cup and when it is screwed downwardly it raises the adjustment cup which causes the thumb collet to squeeze inwardly, thereby reducing the inside diameter of the thumb hole. Conversely, when the adjustment screw is loosened, the inside diameter of the thumb hole increases.

10 Claims, 2 Drawing Sheets

ADJUSTABLE THUMB HOLE INSERT FOR BOWLING BALLS

BACKGROUND OF THE INVENTION

The field of the invention is sporting goods and the invention relates more particularly to the sport of bowling.

It is well known that the thumb size of a bowler varies during bowling. Typically, it decreases slightly in size and the serious bowler would like to be able to adjust the size of the thumb hole to an optimum size during bowling.

Numerous methods have been used for accomplishing this desired result. One such method is shown in the Gaunt U.S. Pat. No. 4,892,308 where a threaded insert may be selected and screwed into a threaded liner. The liners may be removed and replaced with liners having different inside diameters. The Haza U.S. Pat. No. 4,778,178 has an insert with two telescoped tubes which may be rotated with respect to each other which changes the shape of the insert.

Another patent to Haza, namely U.S. Pat. No. 4,561,654, utilizes a flexible tube or sleeve which has a conical wedge on its outer surface. This wedge can either relax or constrict the diameter of the thumb hole. The Ginder U.S. Pat. No. 3,416,796 has a flexible tapered wall which can be moved inwardly and outwardly within an outer tapered member to increase or decrease the inside diameter of the thumb hole. The Bunk, et al. U.S. Pat. No. 3,012,783 has a flexible tube which may be expanded or contracted to change the inside diameter of the thumb hole. Lastly, the Darby U.S. Pat. No. 2,210,528 has a sleeve which is slotted at the top and which may be drawn down into the tapered thumb hole to reduce the thumb hole size.

Although these numerous attempts have made to provide a usable adjustable thumb hole, they have not successfully solved the problem and none have found widespread use.

SUMMARY OF THE INVENTION

It is an object of the present invention to provide an easily adjusted thumb hole for use in a bowling ball.

The present invention is for an adjustable thumb hole insert for a bowling ball. The bowling ball has a oversized thumb hole which has an internal surface, a top and a bottom. An adjustment cup is positioned within the thumb hole and the adjustment cup has an outer surface which is adjacent the internal surface of the thumb hole and the adjustment cup has an inner surface, a bottom and an open top. The open top has an inward bevel and the bottom has an angled surface. A thumb collet having a generally cylindrical sidewall is positioned within the adjustment cup. The thumb collet has a plurality of upwardly and downwardly extending slots which overlap one another. The thumb collet is tapered at the top and at the bottom. The adjustment cup may be moved upwardly or downwardly which squeezes the thumb collet inwardly or permits it to move outwardly to adjust the size of the thumb hole. Preferably an adjustment screw is located at the bottom of the adjustment cup and may be turned inwardly or outwardly with a shaped tool to permit the easy adjustment of the thumb hole size.

DESCRIPTION OF THE PREFERRED EMBODIMENTS

Figure 1:
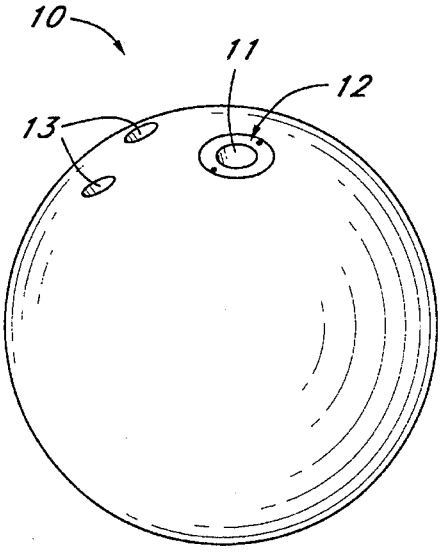
FIG. 1 Is a perspective view of a bowling ball, including the adjustable thumb hole insert of the present invention.
Figure 2:
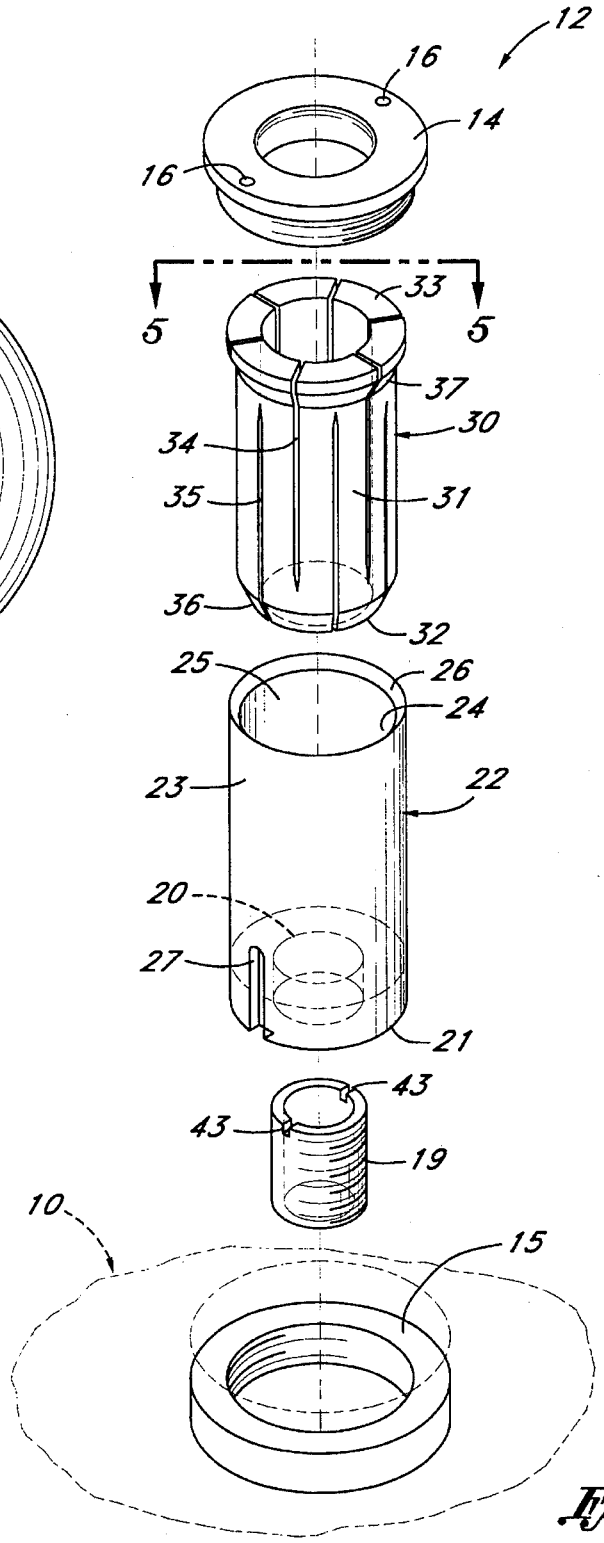
FIG. 2 is an exploded perspective view of the adjustable i:L thumb hole insert of the bowling ball of FIG. 1.
Figure 4:
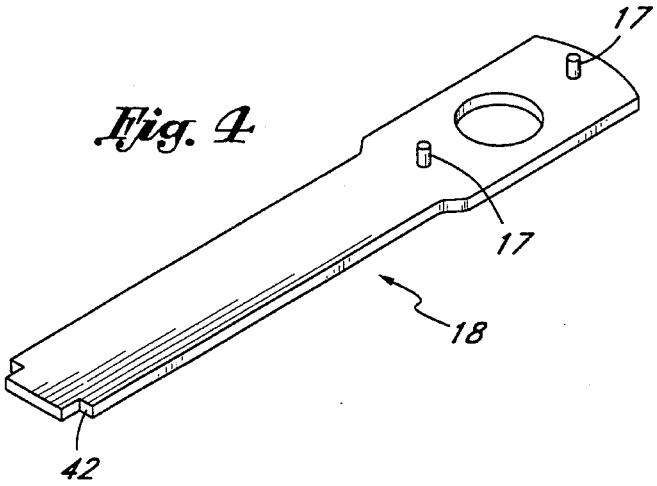
FIG. 4 is a perspective view of an adjusting tool useful with the adjustable thumb hole insert of the present invention.

A bowling ball is shown in perspective view in FIG. 1 and indicated by reference character 10. Bowling ball 10 has a thumb hole 11 which includes an adjustable thumb hole insert 12 shown in exploded perspective view in FIG. 2. A pair of finger holes 13 are also shown in bowling ball 10.

Figure 3:
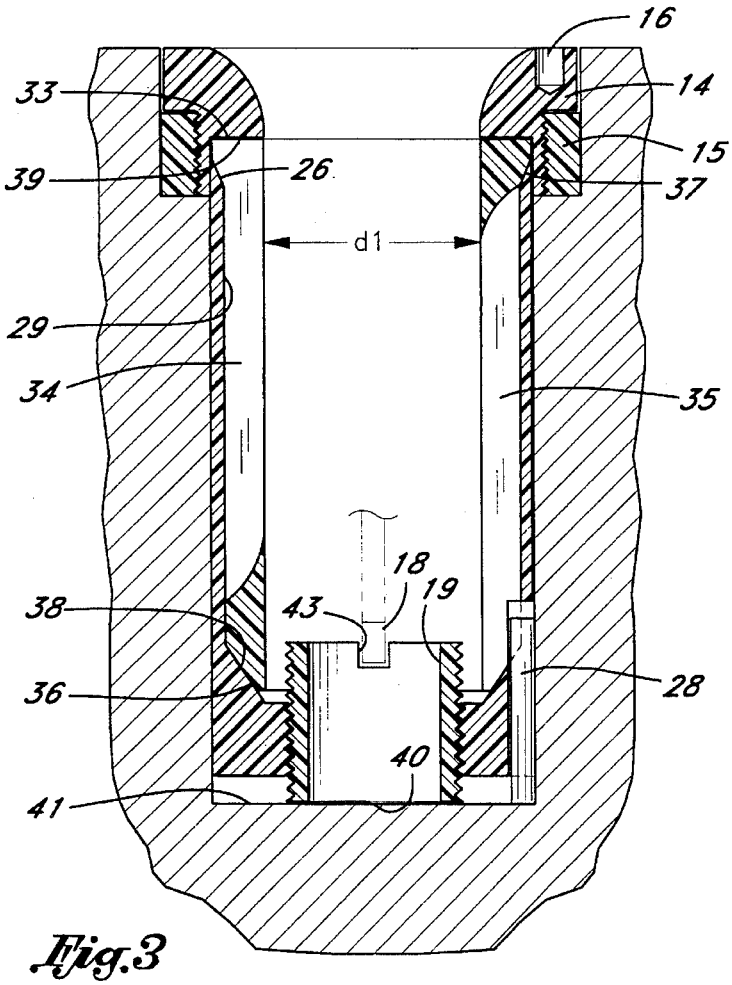
FIG. 3 is a cross-sectional view of the adjustable thumb hole insert of FIG. 2.

Adjustable thumb hole insert 12 is secured to bowling ball 10 by a securement cap 14 which is threaded in a cap securement ring 15 which is glued or otherwise secured in an oversized thumb hole as shown best in FIG. 3 of the drawings. Securement cap 14 has a pair of tightening holes 16 which mate with pegs 17 on tool 18 to tighten securement cap into ring 15. An adjustment screw 19 is threaded into a threaded opening 20 in the bottom 21 of an adjustment cup 22. Adjustment cup 22 has a generally cylindrical sidewall which has an outer surface 23 and an inner surface 24. It has an open top 25 which has an inwardly directed bevel 26. A keyway 27 is formed on the outer side which mates with a key 28 affixed to the inner surface of oversized stepped thumbhole 29 as shown in FIG. 3. A thumb collet 30 fits within adjustment cup 22 and has a generally cylindrical sidewall 31, a bottom 32 and a top 33. Six downwardly extending slots 34 extend from top 33 to near the bottom 32 of collet 30. Six upwardly extending slots 35 extend from bottom 32 to near the top 33. Bottom 32 is tapered at 36 and an outwardly directed taper 37 is formed below top 33. Taper 36 mates with angled surface 38 shown best in FIG. 3 of the drawings at the inner bottom of adjustment cup 22. Top 33 of thumb collet 30 touches thumb collet abutment surface 39 at the bottom of securement cap 14 as shown best in FIG. 3.

Figure 5:
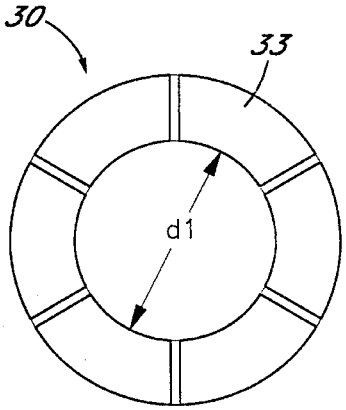
FIG. 5 is a top view of the thumb collet of the adjustable thumb hole insert of FIG. 2 in an expanded configuration.
Figure 6:
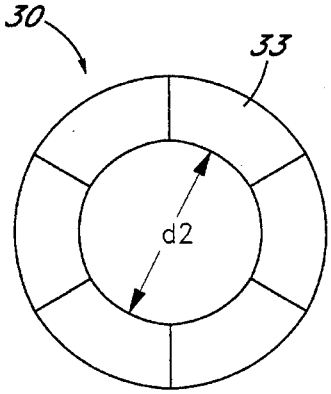
FIG. 6 is a top view of the thumb collet of the adjustable thumb hole insert of FIG. 2 in a compressed configuration.

Turning now to FIG. 3, the assembled adjustable thumb hole insert is shown. The securement cap 14 has been tightly threaded into the threaded cap securement ring 15 which is glued or otherwise secured to the upper end of oversized stepped thumb hole 29. Adjustment screw 19 has a bottom 40 which abuts the bottom 41 of hole 29. Adjusting tool 18 is shown in phantom view in FIG. 3 where its bottom end 42 fits within and mates with the screw slots 43 to raise and lower adjustment cup 22. As adjustment screw 19 is tightened, adjustment cup 22 raises, thereby forcing angled surface 38 against taper 36 at outwardly directed taper 37 against inward bevel 26. Since the thumb collet abutment surface 39 does not permit the thumb collet 30 to rise, it, therefore, is squeezed from a position in FIG. 5 where the inside diameter is indicated by "d1" to a tightened position as shown in FIG. 6 with an inside diameter indicated by "d2". The adjustment can be made anywhere between these two diameters to provide a full range of adjustability for a given bowler.

The adjustable thumb hole insert of the present invention is preferably fabricated from a relatively rigid polymer, such as polycarbonate. While six slots are shown, of course, a greater or lesser number could be used, although six is preferred.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. An adjustable thumb hole insert in combination with an oversized thumb hole in a bowling ball, said insert further comprising:

a thumb collet held within said oversized thumb hole, said thumb collet having a hollow, generally cylindrical side wall, a top, a bottom, a height, an inner surface and an outer surface, and an inner diameter, said thumb collet having a plurality of downwardly extending slots extending downwardly from said top more than half said height, and a plurality of upwardly extending slots extending upwardly from said bottom more than half said height, said thumb collet having a tapered upper end and a tapered lower end;

a tapered base held within said oversized thumb hole near the bottom of the oversized thumb hole said tapered base having a tapered portion in contact with said tapered lower end of said thumb collet;

a tapered top held within said oversized thumb hole, said tapered top being near the top of the oversized thumb hole said tapered top having a tapered section in contact with said tapered upper end; and means for adjustably moving the tapered base toward said tapered top to reduce an inner diameter of said thumb collet and away from said tapered top to enlarge said inner diameter.

2. The adjustable thumb hole insert of claim 1 wherein said tapered base is formed in a bottom of an adjustment cup which has a generally cylindrical side wall surrounding the generally cylindrical side wall of said thumb collet.

3. The adjustable thumb hole insert of claim 2 wherein said adjustment cup has a threaded opening in the bottom thereof and an adjustment screw is threaded therein.

4. The adjustable thumb hole insert of claim 3 wherein said adjustment cup has an inwardly beveled upper end and said thumb collet has a mating outwardly tapered ring area near the top thereof and said insert further has a securement cap affixable to an oversized thumb hole of a bowling ball.

5. The adjustable thumb hole insert of claim 4 wherein said thumb collet has six upwardly extending slots and six downwardly extending slots.

6. An adjustable thumb hole insert in combination with:

a bowling ball having an oversized thumb hole having an internal surface, a top, and a bottom; said insert further comprising:

an adjustment cup positioned within said thumb hole, said adjustment cup having an outer surface adjacent the internal surface of said thumb hole, an inner surface, a bottom having an upwardly facing beveled surface and an open top, said open top having an inward bevel;

a thumb collet having a generally cylindrical side wall, a top and a bottom and having a plurality of downwardly extending slots extending from said top and a plurality of upwardly extending slots extending from the bottom, an outwardly directed taper at the top which abuts the inward bevel of the open top of said adjustment cup and an inwardly directed taper at the bottom which matches the upwardly facing beveled surface at the bottom of the adjustment cup;

a securement cap affixed to said bowling ball at the top of the thumb hole, said securement cap having a thumb collet abutment surface which abuts the top of the thumb collet; and means for adjustably raising and lowering said adjustment cup in said thumb hole.

7. The adjustment thumb hole insert of claim 6 wherein said means for adjustably raising and lowering said adjustment cup in said thumb hole comprises an externally threaded screw held in threads formed in the bottom of said adjustment cup, said externally threaded screw having a bottom which abuts the bottom of said oversized thumb hole.

8. The adjustment thumb hole insert of claim 7 wherein said externally threaded screw is a hollow cylindrical screw having a pair of opposed slots for the affixment of an adjustment tool.

9. The adjustment thumb hole insert of claim 7 wherein said adjustment cup includes means for preventing the turning thereof within said oversized thumb hole.

10. The adjustment thumb hole insert of claim 9 wherein said means for preventing the turning comprises a keyway formed in the outer surface of said adjustment cup and a mating key affixed to the internal surface of said oversized thumb hole near the bottom thereof.

* * * * *